US007904009B2

(12) United States Patent
Maezawa et al.

(10) Patent No.: US 7,904,009 B2
(45) Date of Patent: Mar. 8, 2011

(54) DEVELOPMENT DEVICE AND IMAGE FORMING APPARATUS

(75) Inventors: Nobuhiro Maezawa, Yamato-koriyama (JP); Toyoka Aimoto, Nara (JP); Tomohiro Maeda, Yao (JP)

(73) Assignee: Sharp Kabushiki Kaisha, Osaka (JP)

( * ) Notice: Subject to any disclaimer, the term of this patent is extended or adjusted under 35 U.S.C. 154(b) by 470 days.

(21) Appl. No.: 12/051,151

(22) Filed: Mar. 19, 2008

(65) Prior Publication Data

US 2008/0232861 A1 Sep. 25, 2008

(30) Foreign Application Priority Data

Mar. 19, 2007 (JP) ..... 2007-070444

(51) Int. Cl.
*G03G 15/08* (2006.01)
*G03G 15/09* (2006.01)

(52) U.S. Cl. ..... 399/277; 399/274; 399/284

(58) Field of Classification Search ..... 399/263, 399/264, 265, 267, 274, 277, 282, 284
See application file for complete search history.

(56) References Cited

U.S. PATENT DOCUMENTS 5,702,812 A * 12/1997 Bracken et al. ..... 428/323
5,708,943 A * 1/1998 Applegate et al. ..... 399/284
5,727,022 A * 3/1998 Schafer et al. ..... 375/238
5,828,936 A * 10/1998 Shimizu et al. ..... 399/275
6,067,433 A * 5/2000 Kimura et al. ..... 399/274
6,751,433 B2 * 6/2004 Sugihara ..... 399/267
7,171,145 B2 * 1/2007 Takeuchi et al. ..... 399/274
7,643,779 B2 * 1/2010 Mabuchi et al. ..... 399/274
2008/0232861 A1 * 9/2008 Maezawa et al. ..... 399/277

FOREIGN PATENT DOCUMENTS

JP 11-24407 1/1999
JP 3305138 5/2002

* cited by examiner

*Primary Examiner* — David M Gray
*Assistant Examiner* — Francis Gray
(74) *Attorney, Agent, or Firm* — Nixon & Vanderhye, PC

(57) ABSTRACT

The development device of this invention includes a developer bearing member, a magnet, and a developer regulation member. The magnet is fixedly disposed within the interior of the developer bearing member. The developer regulation member includes at least a magnetic member. And the thickness of this magnetic member along the rotational direction of the developer bearing member is between 0.2 mm and 0.4 mm inclusive. Moreover, if the distance over the developer bearing member, from the position thereupon which the center of the magnetic member along the rotational direction opposes, to the position thereupon at which the magnetism of that magnetic pole which is disposed closest to that position is a maximum, is termed L (mm), and the diameter of the developer bearing member is termed D (mm), then the magnetic member is disposed within the range in which the relationship $0 \leqq L/D \leqq 0.044$ holds.

8 Claims, 9 Drawing Sheets

FIG.7

| EMBODIMENT | MAGNETIC BLADE THICKNESS (MM) | CROSS SECTIONAL AREA (MM2) | MAGNETIC PERMEABILITY | OTHER (OTHER DIFFERENCES FROM EMBODIMENT 1) | DEVELOPER CONVEYANCE AMOUNT (G/CM2) | TONER ADHESION AMOUNT UPON PHOTOSENSITIVE DRUM (MG/CM2) | DEVELOPER FLUIDITY | DEVELOP-MENT SLEEVE FILMING | SPIKES OF DEVELOPER |
|---|---|---|---|---|---|---|---|---|---|
| 1 | 0.2 | 2.0 | 475 | – | 41 | 0.98 | ○ | ◎ | ○ |
| 2 | 0.3 | 2.1 | 475 | – | 45 | 0.92 | ○ | ◎ | ○ |
| 3 | 0.3 | 2.1 | 300 | – | 35 | 0.91 | ◎ | ◎ | ○ |
| 4 | 0.2 | 1.0 | 495 | – | 46 | 0.90 | ◎ | ◎ | ○ |
| 5 | 0.2 | 2.0 | 475 | SURFACE ROUGHNESS 5 μM | 30 | 0.96 | ◎ | ◎ | ○ |
| 6 | 0.2 | 2.0 | 475 | SURFACE ROUGHNESS 12 μM | 50 | 1.10 | ○ | ○ | ◎ |
| 7 | 0.4 | 2.0 | 475 | – | 42 | 0.95 | ○ | ◎ | ○ |
| 8 | 0.2 | 2.0 | 475 | UPSTREAM L/D = 0.044 | 41 | 0.95 | ○ | ◎ | ○ |
| 9 | 0.2 | 2.0 | 475 | DOWNSTREAM L/D = 0.044 | 44 | 0.90 | ○ | ◎ | ○ |

(◎: excellent , ○: good )

FIG.8

| COMPARISON EXAMPLE | MAGNETIC BLADE THICKNESS (MM) | CROSS ARSECTION ALEA (MM2) | MAGNETIC PERME-ABILITY | OTHER (OTHER DIFFERENCES FROM EMBODIMENT 1) | DEVELOPER CONVEYANCE AMOUNT (G/CM2) | TONER ADHESION AMOUNT UPON PHOTOSENSITIVE DRUM (MG/CM2) | DEVELOPER FLUIDITY | DEVELOP-MENT SLEEVE FILMING | SPIKES OF DEVELOP-ER |
|---|---|---|---|---|---|---|---|---|---|
| 1 | – | – | – | NON-MAGNETIC BLADE | 90 | 0.72 | × | △ | × |
| 2 | 0.2 | 2.2 | 475 | – | 39 | 0.80 | △ | △ | △ |
| 3 | 0.4 | 2.0 | 475 | MADE BY PRESSING | 38 | 0.92 | ○ | △ | × |
| 4 | 0.2 | 0.8 | 475 | – | 52 | 0.88 | ○ | △ | × |
| 5 | 0.2 | 2.0 | 500 | – | 46 | 0.83 | △ | ◎ | △ |
| 6 | 0.2 | 2.0 | 295 | – | 44 | 0.75 | ○ | △ | × |
| 7 | 0.2 | 2.0 | 475 | MADE FROM ALUMINUM | 65 | 0.91 | ○ | × | ○ |
| 8 | 0.2 | 2.0 | 475 | UPSTREAM L/D = 0.052 | 35 | 0.81 | △ | ◎ | × |
| 9 | 0.2 | 2.0 | 475 | DOWNSTREAM L/D = 0.052 | 41 | 0.74 | ○ | ○ | × |
| 10 | 0.5 | 2.0 | 475 | – | 44 | 0.72 | ○ | △ | × |
| 11 | 0.2 | 2.0 | 475 | SURFACE ROUGHNESS 4 μM | 25 | 0.66 | ○ | × | × |
| 12 | 0.2 | 2.0 | 475 | SURFACE ROUGHNESS 13 μM | 67 | 0.90 | × | △ | ○ |
| 13 | 0.4 | 2.0 | 275 | NICKEL PROPORTION 3% | 44 | 0.75 | ○ | △ | × |

(◎ :excellent , ○ : good , △ : poor , × : bad )

DEVELOPMENT DEVICE AND IMAGE FORMING APPARATUS

CROSS REFERENCE

This Nonprovisional application claims priority under 35 U.S.C. §119(a) on Patent Application No. 2007-070444 filed in Japan on Mar. 19, 2007, the entire contents of which are hereby incorporated by reference.

BACKGROUND OF THE TECHNOLOGY

The present technology relates to a development device which, in image forming processing using a two-component developer, converts an latent electrostatic image into a visible image, and to an image forming apparatus which incorporates such a development device.

In the process of image forming by a method of electronic photography, a member for bearing a latent image, which has been electrified to a uniform electrical potential, is exposed to light corresponding to image information, and thereby an latent electrostatic image is formed upon this latent electrostatic image bearing member, and then this latent electrostatic image is developed into a visible image with a development device. As methods for developing such a latent electrostatic image, there are a single-component development method which uses a magnetic single-component developer or a non-magnetic single component developer, and a two-component development method which uses a two-component developer including a toner and a carrier. The carrier consists of magnetic particles.

With such a two-component method, the carrier and the toner are mixed and ground together and are mutually frictionally electrified, and thereby the toner is carried upon the surface of the carrier. The carrier which is carrying the toner is formed into the shape of projections—so called spikes—upon the surface of a developer bearing member which incorporates a magnet. As for example described in JP 3,305,138 B, the latent electrostatic image is developed due to the toner in the spikes upon the developer bearing member shifting to the latent electrostatic image upon the latent electrostatic image bearing member.

With this two-component development method the device is slightly more complicated as compared to the single-component development method, but this method is very often used, since it is comparatively simple and easy to set the electrical potential of the toner, and since the high speed capability and stability are excellent.

As a method for regulating the layer thickness of the two-component developer upon the surface of the member which bears this developer, apart from a method using a non-magnetic blade, there is also a known method using a magnetic blade (a magnetic member).

However, with such a method which uses a magnetic blade, coarseness can easily occur in half-tone regions in which the reflection density of the image for development is less than 0.3, and in particular in low density regions such as photographic images and the like.

Moreover, if the magnetic blade is thick in the direction along the direction of conveyance of the (two-component) developer (for example if its thickness is 1.0 mm), then the spikes into which the developer has stood up on the developer bearing member become thick and also short, and the shifting of the developer from within these spikes to the latent electrostatic image bearing member is hindered, so that density blotching and whiteout can easily occur in the image when printing the high density regions. Furthermore, the ends of the spikes into which the developer has stood up may become bent over due to the time period required until they leave the magnetic blade becoming long, and in this case the efficiency of development is deteriorated.

An object is to provide a development device, and an image forming apparatus incorporating such a development device, with which the efficiency of development is good, and which can suppress coarseness, light and dark blotching, and whiteout.

SUMMARY OF THE TECHNOLOGY

The development device is one which converts a latent electrostatic image into a visible image by image forming processing with a method of electronic photography which uses a two-component developer; and it includes a developer bearing member, a magnet, and a developer regulation member. The developer bearing member rotates while bearing a two-component developer, and conveys said two-component developer to a development region which opposes said latent electrostatic image bearing member. The magnet is fixedly disposed within the interior of the developer bearing member. And the developer regulation member opposes the developer bearing member at a position on the upstream side of the development region with respect to the direction of rotation of the developer bearing member, while providing a gap between them. The developer regulation member includes at least a magnetic member. And the thickness of this magnetic member along the rotational direction of the developer bearing member is between 0.2 mm and 0.4 mm inclusive. Moreover, if the distance over the developer bearing member, from the position thereupon which the center of the magnetic member along its rotational direction opposes, to the position thereupon at which the magnetism of that magnetic pole which is disposed closest to that position is a maximum, is termed L (mm), and the diameter of the developer bearing member is termed D (mm), then the magnetic member is disposed within the range in which the relationship $0 \leqq L/D \leqq 0.044$ holds.

Since, with this structure, the thickness of the magnetic member along the direction of rotation of the developer bearing member is less than or equal to 0.4 mm, accordingly the developer upon the developer bearing member is elongated along the radial direction of the developer bearing member and moreover stands up into fine spike shapes. Due to this, the density of the developer upon the developer bearing member becomes smaller. And, because of these facts, when the latent electrostatic image is converted into a visible image, the developer within the spikes can easily shift to the latent electrostatic image bearing member, and thus it is possible to enhance the efficiency of development. Accordingly, it is possible to suppress coarseness, dark blotching, and whiteout.

Furthermore while, with current techniques, manufacturing the magnetic member with a thickness of less than 0.2 mm is difficult, by contrast, it can be formed with a thickness of greater than or equal to 0.2 mm with good accuracy, and accordingly the efficiency of development is enhanced.

Moreover, since the density of the developer upon the developer bearing member becomes small, accordingly the gap required between the developer bearing member and the developer regulation member in order to convey a predetermined amount of developer can be set larger, so that it is possible to prevent excessive friction between the developer and the developer regulation member. Due to this, it is possible to prevent deterioration of the developer, and to suppress decrease of the fluidity of the developer.

Yet further, if the magnetic member is arranged in a position within the range in which the value of L/D is between 0 and 0.044 inclusive, then it is possible for the magnetic member sufficiently to receive the influence of the magnetism of the magnetic pole in the position which most closely opposes the magnetic member. Due to this, it is possible for the developer upon the developer bearing member to stand up into fine spikes, and accordingly it is possible to regulate the layer thickness of the developer upon the developer bearing member with good accuracy.

BRIEF DESCRIPTION OF THE DRAWINGS

FIG. 7 is a figure showing evaluations of development devices according to embodiments 1 through 9;

FIG. 8 is a figure showing evaluations of development devices according to comparison examples 1 through 13.

DETAILED DESCRIPTION OF THE TECHNOLOGY

Figure 1:
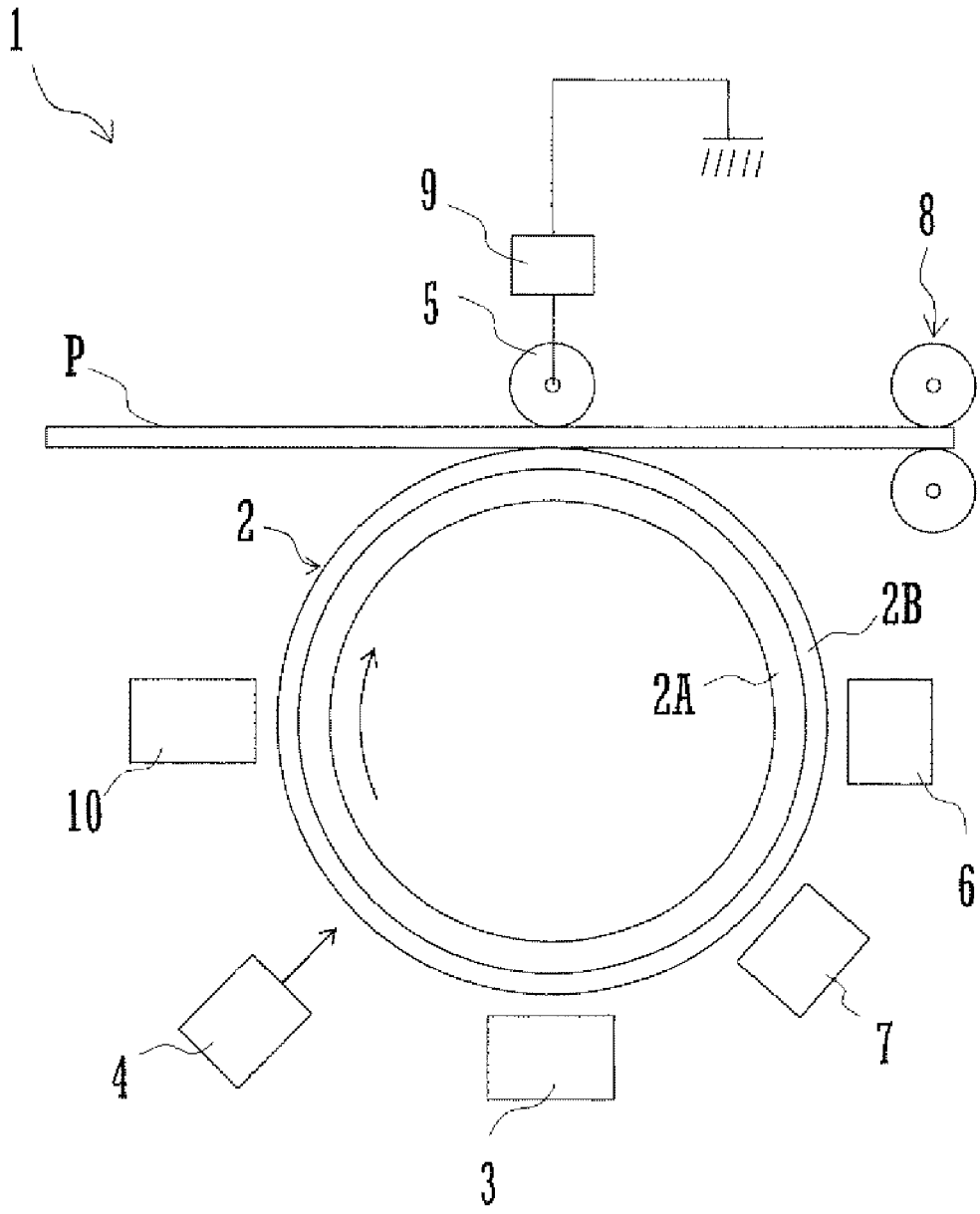
FIG. 1 is a sectional view showing the structure of a portion of an image forming apparatus which incorporates a development device.

In the following, preferred embodiments for implementing the technology will be explained with reference to the drawings. FIG. 1 is a sectional view showing the structure of a portion of an image forming apparatus 1 which comprises a development device 10.

This image forming apparatus 1 employs a two-component development method in which, as a developer, there is used a two-component developer which includes a toner and a carrier consisting of magnetic particles. And this image forming apparatus 1 comprises a photoreceptor drum 2, a charge unit 3, an exposure device 4, a development device 10, a transfer unit 5, a toner cleaning device 6, a charge cleaning unit 7, a fixing device 8, and a power supply 9.

The photoreceptor drum 2 rotates in the clockwise direction in FIG. 1, and corresponds to the "latent electrostatic image bearing member" of the Claims. The charge unit 3, the exposure device 4, the development device 10, the transfer unit 5, the toner cleaning device 6, and the charge cleaning unit 7 are disposed around the photoreceptor drum 2 in that order along its direction of rotation.

A sheet of blank paper P, which is one example of a recording medium, is conveyed in the rightwards direction in FIG. 1 between the photoreceptor drum 2 and the transfer unit 5. And the fixing device 8 is disposed on the downstream side of the transfer unit 5, i.e. in the direction of conveyance of this blank paper sheet P.

The photoreceptor drum 2 comprises a drum shaped layer of backing material 2A, and a photoconductive layer 2B which is made as a thin layer upon the outer circumferential surface of this backing material layer 2A. A metal such as aluminum or the like may be used as the backing material. Moreover, a material such as an organic photo-semiconductor (OPC: Organic Photo-Conductor) or amorphous silicon (a-Si) or the like may be used as the photoconductive layer 2B.

The charge unit 3 electrifies the outer circumferential surface of the photoreceptor drum 2 in a uniform manner. A belt-shaped electrical wire such as tungsten wire or the like, a shield plate made from metal, a corona electrification unit consisting of a grid plate, or an electrification roller or an electrification brush or the like may be used as this charge unit 3.

The exposure device 4 forms a latent electrostatic image upon the outer cylindrical surface of the photoreceptor drum 2 by irradiating light thereupon according to image information. A laser or an LED (Light Emitting Diode) or the like may be used as this exposure device 4.

The development device 10 converts this latent electrostatic image into a visible toner image by supplying toner onto the outer circumferential surface of the photoreceptor drum 2 with a development electrical field which is created between the photoreceptor drum 2 and the development device 10. This development device 10 is provided with a biasing power supply which is not shown in the figures.

The transfer unit 5 transcribes the toner image onto the blank sheet P of paper with the transcription bias which is applied from the power supply 9. A transcription roller, an electrification brush, a corona electrification unit or the like may be used as the transfer unit 5.

The fixing device 8 fixes the toner image onto the blank sheet P of paper by heating and pressurizing the toner which has been transcribed onto the paper sheet P as above.

After the toner image has been transcribed onto the blank paper sheet P, the toner cleaning device 6 removes any toner which remains upon the outer circumferential surface of the photoreceptor drum 2. This toner cleaning device 6 may incorporate, for example, a cleaning blade.

And, after the toner has been thus removed, the charge cleaning unit 7 removes the electrical charge from the outer circumferential surface of the photoreceptor drum 2.

The outer circumferential surface of the photoreceptor drum 2, from which the electrical charge has been removed by the charge cleaning unit 7, is again uniformly electrified for a second time by the charge unit 3. And another latent electrostatic image is created by the exposure device 4 upon the outer circumferential surface of the photoreceptor drum 2. This new latent electrostatic image is again converted into a toner image by the development device 10. And this toner image is again transcribed onto another sheet P of blank paper by the transfer unit 5, and is fixed onto this paper sheet P by the fixing device 8. Any toner which remains upon the outer circumferential surface of the photoreceptor drum 2 is removed by the toner cleaning device 6, and then the outer circumferential surface of the photosensitive drum is de-electrified by the charge cleaning unit 7. In this manner, the process of image creation is repeated according to requirements.

Figure 2:
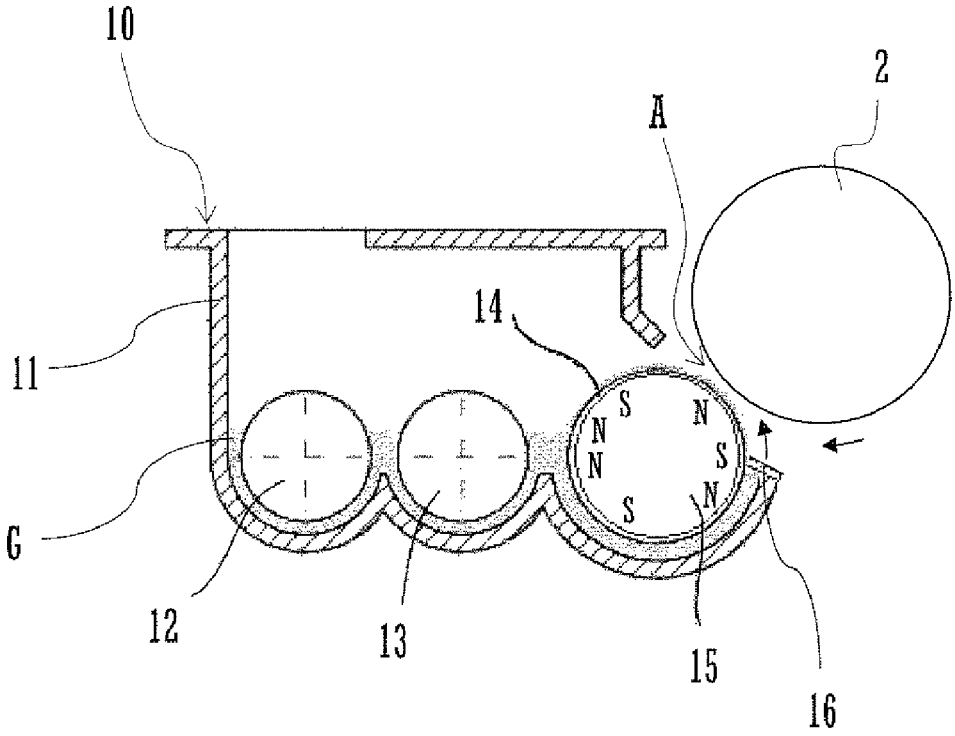
FIG. 2 is a sectional view showing the schematic structure of this development device.

FIG. 2 is a sectional view showing the schematic structure of the development device 10.

The development device 10 comprises a housing 11, agitation and conveyance rollers 12 and 13, a development sleeve 14, a magnet 15, and a doctor blade 16. The development sleeve 14 corresponds to the "developer bearing member" of the Claims. And the doctor blade 16 corresponds to the "developer regulation member" of the Claims.

As described above, a two-component developer which includes a toner and a carrier is used as the developer G. This developer is contained within the housing 11. For example, the diameter of the toner particles may be around 6.2 μm, and the diameter of the carrier particles may be around 50 μm.

The agitation and conveyance rollers 12 and 13 are contained within the housing 11, and, along with stirring up and agitating the developer G, also convey it to the development sleeve 14. At this time, the toner particles are carried upon the surface of the carrier particles, due to the carrier and the toner becoming mutually electrified by friction since they are stirred up and agitated by the agitation and conveyance rollers 12 and 13. And the developer G is conveyed to the development sleeve 14 in this state in which the toner particles are carried upon the surfaces of the carrier particles.

The development sleeve 14 is mounted so as to rotate freely within the housing 11, with a portion thereof being exposed to the exterior of the housing 11, and with this portion being positioned so as to oppose the outer circumferential surface of the photoreceptor drum 2. The development sleeve 14 is made from a type of stainless steel which is not magnetic. As the raw material for the development sleeve 14, for example, SUS302, SUS303, SUS304, SUS304Cu, SUS304L, SUS304N1, SUS304J3, SUS305, SUS305J1, SUS309S, SUS310S, SUS316, SUS316L, SUS316N, SUS316Ti, SUS316J1, SUS316F, SUS317, SUS317F, SUS321, or SUS347 or the like may be employed.

The outer circumferential surface of the development sleeve 14 is subjected to sandblasting processing. The ten-point average surface roughness of the outer circumferential surface of the development sleeve 14 should be within the range from 5 μm to 12 μm.

This development device 10 employs a development method in which the portion of the development sleeve 14 which is exposed from the housing 11 rotates from below to above while pulling up a layer of the developer G, and the photoreceptor drum 2 and the development sleeve 14 rotate so that their mutually opposing outer circumferential surfaces move in the same direction (in other words, the photoreceptor drum 2 and the development sleeve 14 rotate in opposite rotational directions). By utilizing this structure in which the development sleeve 14 conveys a layer of the developer G from below to above, it becomes possible to convey the developer G, a sufficient quantity of which is accumulated in the lower portion of the development device 10, to the development region A, and this conveyance process is robust and is unlikely to suffer any problem.

The magnet 15 has a plurality of poles, and is fixedly disposed within the interior of the development sleeve 14, so that it does not rotate.

The doctor blade 16 is disposed more upstream with respect to the direction of rotation of the development sleeve 14, than the development region A where the development sleeve 14 and the photoreceptor drum 2 come into mutual opposition. This doctor blade 16 regulates the thickness of the layer of developer G which is borne upon the outer circumferential surface of the development sleeve 14.

Figure 3:
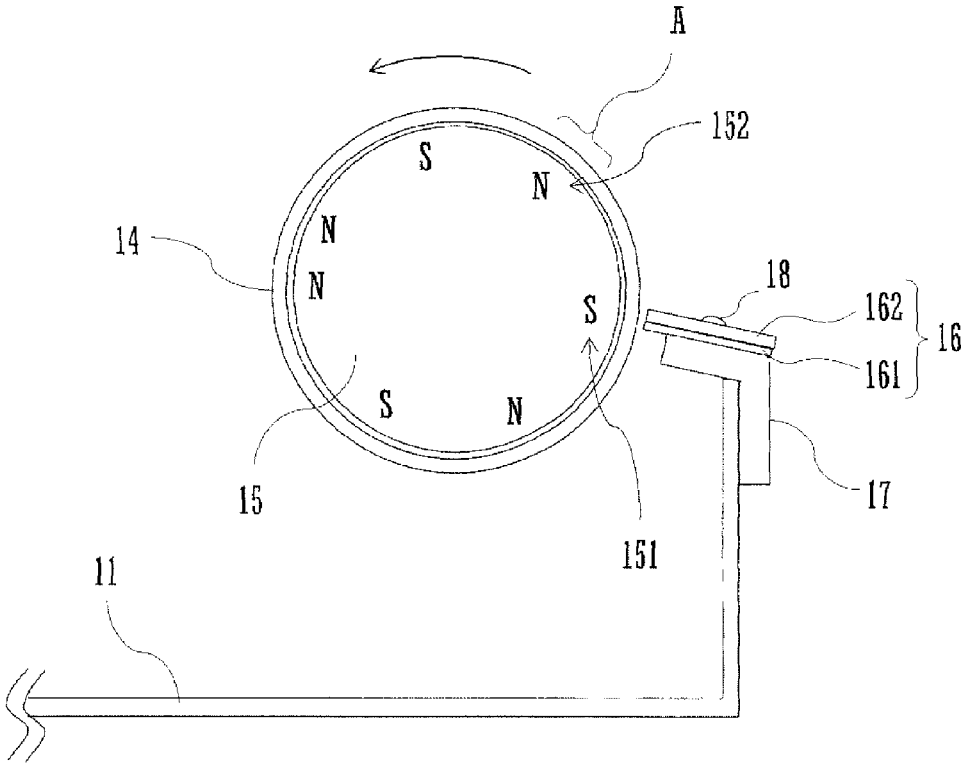
FIG. 3 is a sectional view showing the structure of a portion of the development device.

FIG. 3 is a sectional view showing the structure of a portion of the development device 10.

In this embodiment, the magnet 15, apart from having a regulation pole 151 (an S pole, for example one of 832 Gauss) in a position which opposes the doctor blade 16, and a main pole 152 (an N pole, for example one of 1149 Gauss) in a position which opposes the development region A, also has an S pole, an N pole, an N pole, an S pole, and an N pole; and these magnetic poles are arranged in that specified order around the direction of rotation of the development sleeve 14.

The doctor blade 16 comprises a magnetic blade 161 and a non-magnetic blade 162, with the magnetic blade 161 being disposed more upstream with respect to the direction of rotation of the development sleeve 14, than the non-magnetic blade 162. This magnetic blade 161 and non-magnetic blade 162 are fixed by screws 18 or by rivets or the like to a metallic fixing plate 17 in a closely contacting state, so that the gap between them is 100 μm or less, for example. And the metallic plate 17 is fixed to the housing 11. It would also be acceptable for the magnetic blade 161 and the non-magnetic blade 162 to be directly fixed to the housing 11.

The magnetic blade 161 may be made from a stainless steel which includes a proportion of 1% or less of nickel. The magnetic permeability of the magnetic blade 161 is less than or equal to 500. As the raw material for this magnetic blade 161, for example, SUS403, SUS410, SUS410S, SUS416, SUS420J1, SUS420F, SUS410L, SUS430, SUS430F, SUS434 or the like may be employed.

The non-magnetic blade 162 is not limited to being made of any particular raw material, provided that it is made from a metallic material which is not magnetic. As the raw material for this non-magnetic blade 162, for example, a stainless steel such as SUS302, SUS303, SUS304, SUS304Cu, SUS304L, SUS304N1, SUS304J3, SUS305, SUS305J1, SUS309S, SUS310S, SUS316, SUS316L, SUS316N, SUS316Ti, SUS316J1, SUS316F, SUS317, SUS317F, SUS321, SUS347 or the like, or aluminum or copper may be employed.

Figure 4:
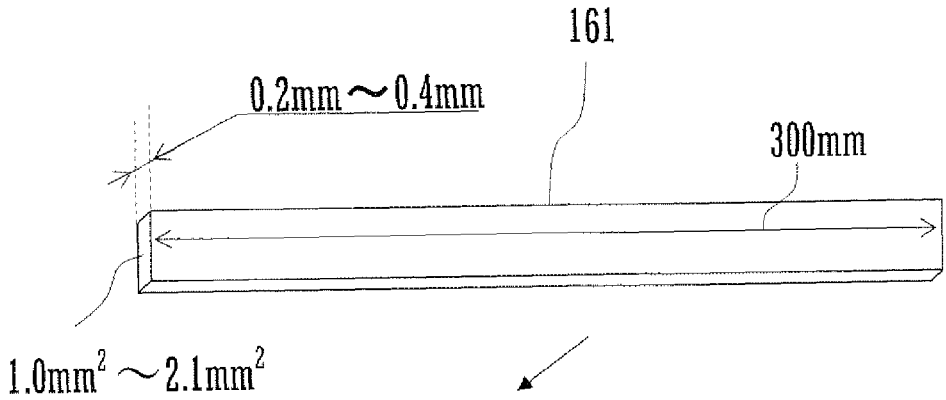
FIG. 4 is a perspective view showing the structure of a magnetic blade.

FIG. 4 is a perspective view showing the structure of the magnetic blade 161.

The thickness of the magnetic blade 161 in its direction along the direction of rotation of the development sleeve 14 is made to be within the range from 0.2 mm to 0.4 mm. And the cross sectional area of the magnetic blade 161, as calculated by multiplying the thickness of the magnetic blade 161 in its direction along the direction of rotation of the development sleeve 14 by the height of the magnetic blade 161 along the radial direction of the development sleeve 14, is greater than or equal to 1.0 $mm^2$ and less than or equal to 2.1 $mm^2$, while the magnetic permeability of the magnetic blade 161 is greater than or equal to 300 and less than or equal to 495.

Moreover, the width of the magnetic blade 161 (in other words its length in the direction which is parallel to the direction of the axis of rotation of the development sleeve 14, i.e. its length along the direction perpendicular to the drawing paper in FIG. 3) is 300 mm.

Figure 5:
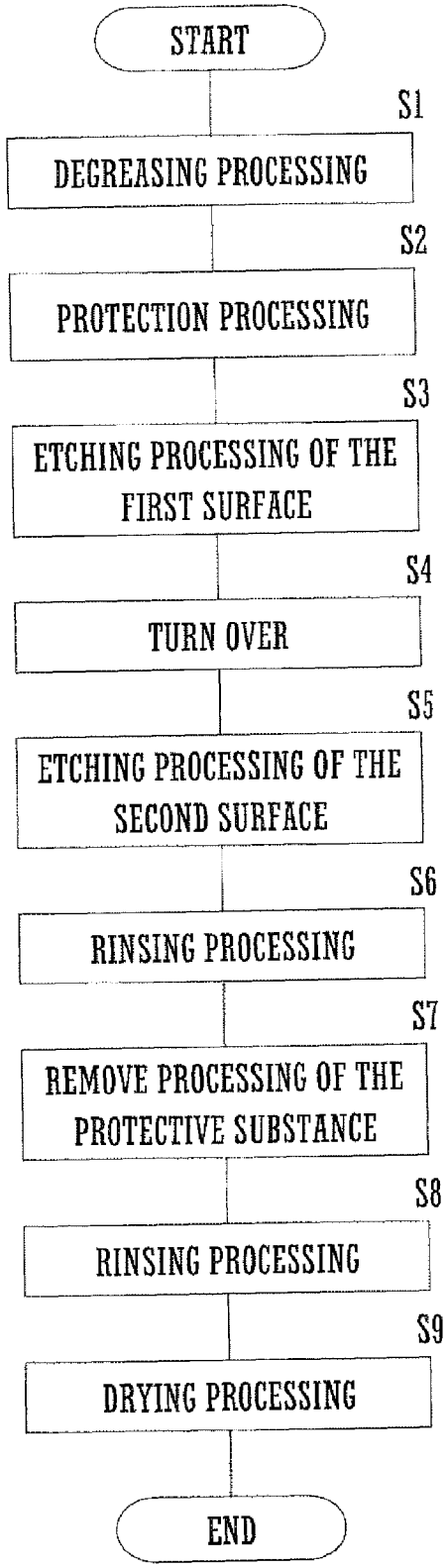
FIG. 5 is a flow chart showing the process of manufacture of the magnetic blade.

FIG. 5 is a flow chart showing the process of manufacture of the magnetic blade 161.

The magnetic blade 161 is formed by performing etching processing from both sides, i.e. from its first surface which is disposed upon the upstream side in the direction of rotation of the development sleeve 14, and from its second surface which is disposed upon the downstream side.

First, in processes before this etching processing, degreasing processing (a step S1) is performed on both the first surface and the second surface of the magnetic blade 161, and then protection processing is performed (a step S2) upon those portions of those surfaces upon which etching processing is not to be performed; and then etching processing of the first surface is performed (a step S3). Next, the magnetic blade 161 is turned over (a step S4), and etching processing is then performed upon the second surface as well (a step S5). At this time, the magnetic blade 161 is turned over from its first surface to its second surface after half the time which would be required for forming it, if etching processing were being performed from only one surface.

As processes which are performed after the etching processing, rinsing (a step S6), removal of the protective material (a step S7), further rinsing (a step S8), and drying (a step S9) are performed in sequence. As the material which is used for the etching processing, for example, an aqueous solution of ferrous chloride (III), dilute hydrochloric acid, dilute sulfuric acid, or dilute nitric acid may be used.

Figure 6:
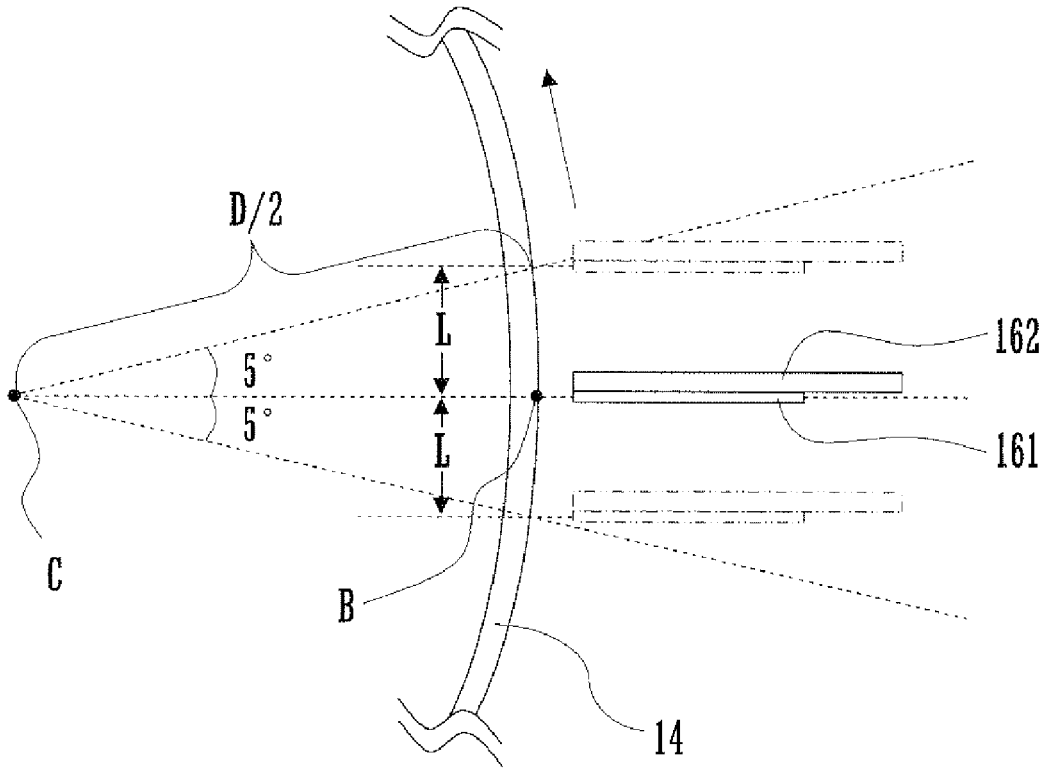
FIG. 6 is a sectional view showing the position of the magnetic blade.

FIG. 6 is a sectional view showing the position of the magnetic blade 161.

If the straight line distance, in the direction along the direction of rotation of the development sleeve 14, from the position upon the development sleeve 14 which the center of the magnetic blade 161 opposes, to the position B thereupon at which the magnetism of that magnetic pole (the regulation pole 151) which is positioned most closely to this position is strongest (this position is shown by the black dot), is termed L, and if the diameter of the development sleeve 14 is termed D (mm), then the magnetic blade 161 is to be positioned within the range in which the relationship $$0 \leqq L/D \leqq 0.044$$

holds.

Thus, taking the center C of the development sleeve 14 as a reference, the magnetic blade 161 is arranged so that the center of the magnetic blade 161 opposes this center C within the ranges from the position B to the positions which are angled at a maximum of 5° forward and backward in the direction along the rotational direction of the development sleeve 14. In this embodiment, the diameter D of the development sleeve 14 is 18 mm, and the distance L is set to 0.79 mm.

Next, experiments were performed using a plurality of specific embodiments and comparison examples, as described below.

Embodiment 1

First, the manufacture of the magnetic blade 161 will be explained. Using a degreasing material (product name: HFE Haya-Clean DS-255, made by Sun Hayato Co., Ltd.), degreasing processing was performed upon a plate of SUS430 of thickness 0.2 mm and of magnetic permeability 475 and having a nickel proportion of 1% or less. Thereafter, portions which were not to be etched were protected using an etching protection material (product name: Flux H-10F, made by Sun Hayato Co., Ltd.), and, after having been soaked for five minutes in an etching liquid (product name: Etching Liquid H-10L, made by Sun Hayato Co., Ltd.), the workpiece was then turned over and was again soaked for five minutes. Then, after the workpiece was rinsed, the etching protection material was removed with a protection material removal material (product name: Flux Removal Material H-1000P, made by Sun Hayato Co., Ltd.), and, after the etching protection material was thus removed, the workpiece was rinsed again and was dried, so that a magnetic blade of thickness 0.2 mm and height 10 mm was manufactured.

Next, the sandblasting processing performed upon the development sleeve 14 will be explained. Using a surface processing device (product name: FDO-S2, made by Fuchioka Co., Ltd.), a development sleeve of ten-point average surface roughness 8 μm was manufactured by performing sandblasting processing with glass beads (product name: glass beads (FGB), range of particle diameter: 53 μm~62 μm, made by Fuji Mfg. Co., Ltd.) for five minutes upon a development sleeve material of diameter 18 mm which was being rotated at 60 rpm.

Furthermore, the position of the doctor blade 16 will be explained. When the straight line distance over the development sleeve 14 from the position thereupon in the direction along the rotational direction of the development sleeve 14 which the center of the magnetic blade 161 opposes, to the position B thereupon at which the magnetism of that magnetic pole which is disposed closest to said position (i.e. of the regulation pole 151) is a maximum, is termed L, and the diameter of the development sleeve 14 is termed D (mm), then the doctor blade 16 is disposed so that the magnetic blade 161 is positioned at a position at which L/D=0 (i.e. so that L=0, which defines the position of 0° from the position B at which the magnetism of the regulation pole 151 is a maximum).

Embodiment 2

The development device of Embodiment 2 was made in a similar manner to that of Embodiment 1, except for the fact that the magnetic blade 161 was 0.3 mm in thickness and 7 mm in height.

Embodiment 3

The development device of Embodiment 3 was made in a similar manner to that of Embodiment 1, except for the fact that the magnetic blade 161 was 0.3 mm in thickness and 7 mm in height, and was made from SUS420 plate having magnetic permeability of 300 and having a nickel proportion of 1% or less.

Embodiment 4

The development device of Embodiment 4 was made in a similar manner to that of Embodiment 1, except for the fact that the magnetic blade 161 was 0.2 mm in thickness and 5 mm in height, and had magnetic permeability of 495.

Embodiment 5

The development device of Embodiment 4 was made in a similar manner to that of Embodiment 1, except for the fact that a development sleeve 14 was used whose ten-point average surface roughness was made to be 5 μm by making the sandblasting processing time period three minutes.

Embodiment 6

The development device of Embodiment 6 was made in a similar manner to that of Embodiment 1, except for the fact that a development sleeve 14 was used whose ten-point average surface roughness was made to be 12 μm by making the sandblasting processing time period eight minutes.

Embodiment 7

The development device of Embodiment 7 was made in a similar manner to that of Embodiment 1, except for the fact that the magnetic blade 161 was 0.4 mm in thickness and 5 mm in height.

Embodiment 8

The development device of Embodiment 8 was made in a similar manner to that of Embodiment 1, except for the fact that the magnetic blade 161 was disposed in such a position that, at the upstream side in the rotational direction of the development sleeve 14 from the development region A, L/D=0.044 (i.e. so that L=0.79 (mm); the blade 161 was inclined by 5° to the upstream side from the position B at which the magnetism of the regulation pole 151 was strongest).

Embodiment 9

The development device of Embodiment 9 was made in a similar manner to that of Embodiment 1, except for the fact that the magnetic blade 161 was disposed in such a position that, at the downstream side in the rotational direction of the development sleeve 14 from the development region A, L/D=0.044 (i.e. so that L=0.79 (mm); the blade 161 was inclined by 5° to the downstream side from the position B at which the magnetism of the regulation pole 151 was strongest).

Comparison Example 1

The development device of Comparison Example 1 was made in a similar manner to that of Embodiment 1, except for the fact that, while the doctor blade 16 had a non-magnetic blade 162 (of thickness 1.0 mm and height 15 mm), it had no magnetic blade 161.

Comparison Example 2

The development device of Comparison Example 2 was made in a similar manner to that of Embodiment 1, except for the fact that the magnetic blade 161 was 0.2 mm in thickness and 11 mm in height.

Comparison Example 3

The development device of Comparison Example 3 was made in a similar manner to that of Embodiment 1, except for the fact that the magnetic blade 161 was made by press forming, and was 0.4 mm in thickness and 5 mm in height.

Comparison Example 4

The development device of Comparison Example 4 was made in a similar manner to that of Embodiment 1, except for the fact that the magnetic blade 161 was 0.2 mm in thickness and 4 mm in height.

Comparison Example 5

The development device of Comparison Example 5 was made in a similar manner to that of Embodiment 1, except for the fact that that the magnetic blade 161 was 0.2 mm in thickness and 10 mm in height, and had magnetic permeability of 500.

Comparison Example 6

The development device of Comparison Example 6 was made in a similar manner to that of Embodiment 1, except for the fact that the magnetic blade 161 was 0.2 mm in thickness and 10 mm in height, and had magnetic permeability of 295.

Comparison Example 7

The development device of Comparison Example 7 was made in a similar manner to that of Embodiment 1, except for the fact that aluminum was used as the raw material of the development sleeve 14.

Comparison Example 8

The development device of Comparison Example 8 was made in a similar manner to that of Embodiment 1, except for the fact that the magnetic blade 161 was disposed in such a position that, at the upstream side in the rotational direction of the development sleeve 14 from the development region A, L/D=0.052 (i.e. so that L=0.942 (mm); the blade 161 was inclined by 6° to the upstream side from the position B at which the magnetism of the regulation pole 151 was strongest).

Comparison Example 9

The development device of Comparison Example 9 was made in a similar manner to that of Embodiment 1, except for the fact that the magnetic blade 161 was disposed in such a position that, at the downstream side in the rotational direction of the development sleeve 14 from the development region A, L/D=0.052 (i.e. so that L=0.942 (mm); the blade 161 was inclined by 6° to the downstream side from the position B at which the magnetism of the regulation pole 151 was strongest).

Comparison Example 10

The development device of Comparison Example 10 was made in a similar manner to that of Embodiment 1, except for the fact that the magnetic blade 161 was 0.5 mm in thickness and 4 mm in height.

Comparison Example 11

The development device of Comparison Example 11 was made in a similar manner to that of Embodiment 1, except for the fact that a development sleeve 14 was used whose ten-point average surface roughness was 4 μm.

Comparison Example 12

The development device of Comparison Example 12 was made in a similar manner to that of Embodiment 1, except for the fact that a development sleeve 14 was used whose ten-point average surface roughness was 13 μm.

Comparison Example 13

The development device of Comparison Example 13 was made in a similar manner to that of Embodiment 1, except for the fact that the magnetic blade 161 was made from a SUS630 plate, 0.4 mm in thickness and 5 mm in height, and having a nickel content proportion of 3% and a magnetic permeability of 275.

The development devices according to Embodiments 1 through 9 and Comparison Examples 1 through 13 above were each evaluated, and the results were as follows.

The Amount of Developer Conveyed

After the development sleeve 14 was rotated for three minutes at 400 rpm using an external idler, the weight of the developer G per unit area was measured.

The Amount of Toner Adhered Upon the Photoreceptor Drum 2

With a photocopier (product name: MX-7000N, made by Sharp Co., Ltd.), by printing 5 full images in succession, and by intentionally causing jamming during the discharge of the first image sheet, the amount of toner adhered upon the photoreceptor drum 2 per unit area was measured by aspiration of the toner upon the photoreceptor drum 2.

Evaluation of the Fluidity of the Developer G

With this photocopier (product name: MX-7000N, made by Sharp Co., Ltd.), after having printed in succession 10,000 images having a printing area of 5% so as to impose a sufficient load upon the developer G, the fluidity of the developer G was measured with a fluidity measurement device (product name: vibration transfer type fluidity measurement device, made by Etwas Co., Ltd.).

At this time, when measurement was performed using the method of JIS B 0601-1994, with a measurement magnification of 1000×, a measurement speed of 0.5 mm/sec, a cutoff of 0.8 mm, and with leveling processing of linear (entire area), evaluation length of 4.0 mm, and preparatory length 0.8 mm: since, when the difference between the surface roughnesses Rz1 and Rz2 became greater than 1.0 μm problems started to occur with conveyance of the developer G, accordingly, in FIGS. 7 and 8: those cases for which this difference was less than 0.5 μm are shown as "(double circle)"; those cases for which this difference was between 0.5 μm and 1.0 μm are shown as "○(circle)", those cases for which this difference was between 1.0 μm and 1.5 μm are shown as "(triangle)", and those cases for which this difference was equal to or greater than 1.5 μm are shown as "X(cross)".

Using a surface roughness measurement device (product name: Surfcorder SE3500, made by Kosaka Laboratory Co., Ltd.), the ten-point average surface roughness Rz1 of the initial development sleeve 14 was measured, and, after having printed 10,000 images of printing area 5% upon a photocopier (product name: MX-7000N, made by Sharp Co., Ltd.), the final ten-point average surface roughness Rz2 of the initial development sleeve 14 was measured.

At this time, when measurement was performed using the method of JIS B 0601-1994, with a measurement magnification of 1000×, a measurement speed of 0.5 mm/sec, a cutoff of 0.8 mm, and with leveling processing of linear (entire area), evaluation length of 4.0 mm, and preparatory length 0.8 mm: since, when the difference between the surface roughnesses Rz1 and Rz2 became greater than 1.0 μm problems started to occur with conveyance of the developer G, accordingly, in FIGS. 7 and 8: those cases for which this difference was less than 0.5 μm are shown as "◎(double circle)"; those cases for which this difference was between 0.5 μm and 1.0 μm are shown as "○(circle)", those cases for which this difference was between 1.0 μm and 1.5 μm are shown as "Δ(triangle)", and those cases for which this difference was equal to or greater than 1.5 μm are shown as "X(cross)".

Evaluation of the Height of the Spike Shapes into which the Developer G Rises

By using a microscope (product name: Digital Microscope VHX-200, made by Keyence Co., Ltd.), and by performing 50 observations, the height of the spike shapes into which the developer G had stood up was measured.

When the height of the spike shapes into which the developer G had stood up was 1.2 mm or greater, then the amount of developer G adhered to the photoreceptor drum 2 became large, and a satisfactory beta image was obtained; and conversely, when the height of the spike shapes into which the developer G had stood up was 1.0 mm or less, then the beta image became pale and unclear, and light and dark blotching and whiteout occurred. Accordingly, in FIGS. 7 and 8: those cases for which the height of the spike shapes into which the developer G had stood up was 1.2 mm or greater are shown as "◎(double circle)"; those cases for which this height was between 1.2 mm and 1.1 mm are shown as "○(circle)", those cases for which this height was between 1.1 mm and 1.0 mm are shown as "(triangle)", and those cases for which this height was less than 1.0 mm are shown as "X(cross)".

FIG. 7 shows the results of evaluation for each of the development devices of Embodiments 1 through 9. Moreover, FIG. 8 shows the results of evaluation for each of the development devices of Comparison Examples 1 through 13.

It is difficult to manufacture a magnetic blade 161 with thickness less than 0.2 mm with present techniques, and, by making its thickness to be greater than or equal to 0.2 mm, it can be formed with greater accuracy, so that the efficiency of development is enhanced.

As will be understood by comparison of Embodiments 1 and 7 through 9 with Comparison Examples 8 through 10, when the thickness of the magnetic blade 161 in the direction along the direction of rotation of the development sleeve 14 was between 0.2 mm and 0.4 mm inclusive, and moreover the value of L/D was between 0 and 0.044 inclusive, the fluidity of the developer G, the advantageous effect of suppression of filming on the development sleeve 14, and the height of the spike shapes into which the developer G stood up, were all of them satisfactory.

Figure 9A:
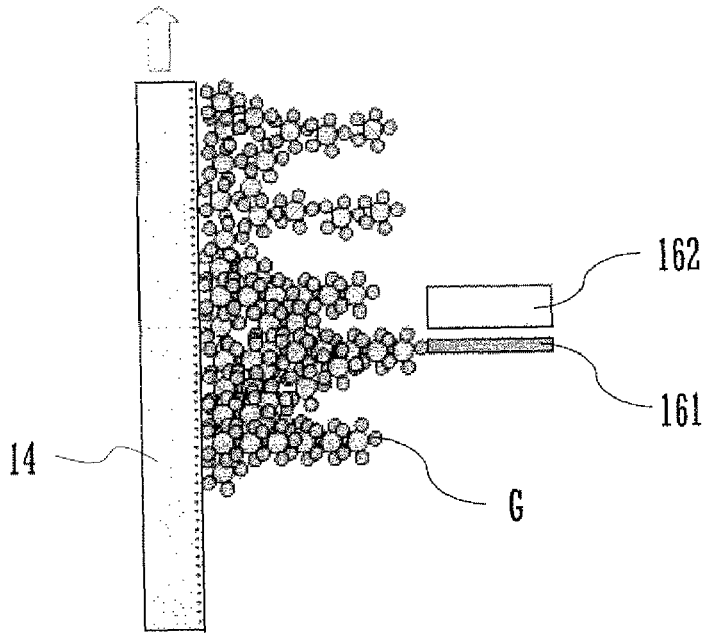
FIGS. 9A and 9B are sectional views showing a state in which developer has stood up in the form of spikes.
Figure 9B:
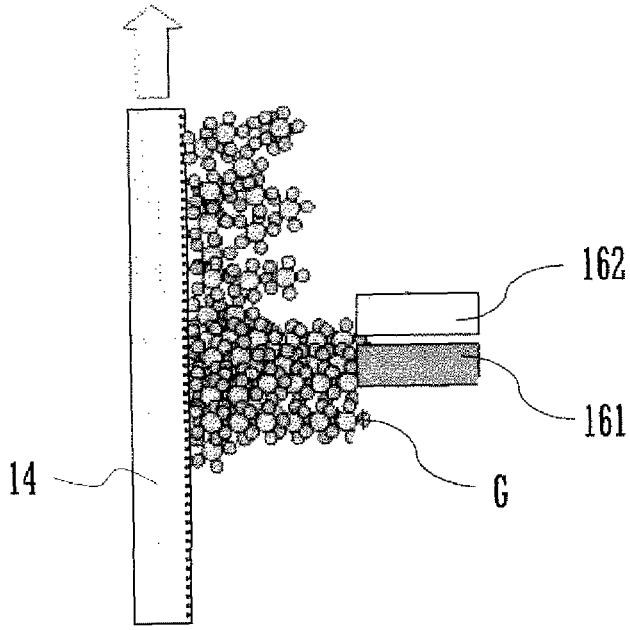

When the thickness of the magnetic blade 161 in the direction along the direction of rotation of the development sleeve 14 was less than or equal to 0.4 mm, as shown in FIG. 9(A), the developer G upon the development sleeve 14 stood up into fine spike shapes which were also elongated in the radial direction of the development sleeve 14, and the density of the developer G upon the development sleeve 14 became low. Due to this, when converting the latent electrostatic image into a visible image, as compared to the case as shown in FIG. 9(B) when the thickness of the magnetic blade was greater than 0.4 mm, the developer G within the spikes shifted easily to the photoreceptor drum 2, so that the efficiency of development was enhanced. Accordingly, coarseness, light and dark blotching, and whiteout were suppressed.

Furthermore, since the density of the developer G upon the development sleeve 14 became low, accordingly the gap between the development sleeve 14 and the doctor blade 16 was made large in order to convey a predetermined amount of developer G, so that excessive friction between the developer G and the doctor blade 16 was suppressed. Due to this, deterioration of the developer G was suppressed, and decrease of the fluidity of the developer G was suppressed.

Moreover, by arranging the magnetic blade 161 in a position for which the value of L/D was within the range between 0 and 0.044 inclusive, it was possible for the magnetic blade 161 sufficiently to experience the influence of the magnetism of that magnetic pole (the regulation pole 151) which was positioned to oppose the magnetic blade 161. Due to this, the standing up of the developer G upon the development sleeve 14 into thin long spikes, and the layer thickness of the developer G upon the development sleeve 14, were regulated with good accuracy.

As will be understood by comparison of Embodiments 1 through 4 with Comparison Examples 2 and 4 through 6, when the cross sectional area of the cross section of the magnetic blade 161 which includes its thickness direction and its height direction was between 1.0 $mm^2$ and 2.1 $mm^2$ inclusive, and moreover, its magnetic permeability was between 300 and 495 inclusive, the height of the spikes into which the developer G stood was satisfactory.

When this cross sectional area was greater than 2.1 $mm^2$ (refer to Comparison Example 2), or when the magnetic permeability was greater than 495 (refer to Comparison Example 5), then the ends of the long thin spikes into which the developer G stood up undesirably lay down, due to the time period required until they were removed from the magnetic blade 161 becoming long, and accordingly the efficiency of development was deteriorated. On the other hand, when this cross sectional area was less than 1.0 $mm^2$ (refer to Comparison Example 4), or when the magnetic permeability was less than 300 (refer to Comparison Example 6), then the developer G was not formed into the desired state of thin long spikes, so that the efficiency of development was deteriorated.

As will be understood by comparison of Embodiment 7 with Comparison Example 13, when the magnetic blade 161 was made from a stainless steel material that had a proportion of nickel of 1% or less, the advantageous effect of suppression of filming upon the development sleeve 14, and the height of the spike shapes into which the developer G stood up upon the development sleeve 14, were both more satisfactory, than in the case when the magnetic blade 161 was made from a stainless steel material that had a proportion of nickel of more than 1% (in Comparison Example 13, 3%).

When the proportion of nickel in the stainless steel exceeds 1%, then the magnetic permeability of the magnetic blade 161 becomes too low, and the spikes up into which the developer G stands become thick and short, so that the efficiency of development is deteriorated. Furthermore, in this case, although it becomes difficult to enhance the efficiency of development if the gap between the magnetic blade 161 and the development sleeve 14 is not closed up, nevertheless, when this gap is closed up, the developer G is deteriorated, and decrease of the fluidity of the developer G takes place. By contrast, if the proportion of nickel in the stainless steel is 1% or less, then the fluidity of the developer G, the advantageous effects of suppression of filming upon the development sleeve 14, and the height of the spikes into which the developer G stands up, all together become satisfactory, and thus the efficiency of development is enhanced.

As will be understood by comparison of Embodiment 7 with Comparison Example 3, when the magnetic blade 161 was formed by etching processing from both sides, both the advantageous effect of suppression of filming upon the development sleeve 14 and the height of the spikes into which the developer G stood up, were both more satisfactory, than when the magnetic blade 161 was formed by a process of press formation.

Since the magnetic blade 161 is rather thin, if this magnetic blade 161 is made by a process of press formation, then deformation or protrusions in the cutting surface can easily occur, so that it becomes difficult to adjust the position of the magnetic blade 161 with high precision. Furthermore, since there are protrusions in the end of the magnetic blade 161, accordingly it is easy for problems to occur with partial conveyance of the developer G, and density blotching or whiteout can easily occur in the image when printed. By contrast, when the magnetic blade 161 is made by a process of etching as in the case of the technology described herein, then there is no generation of deformation or protrusions in the cutting surface, so that it becomes possible to adjust the position of the magnetic blade 161 with high precision. Due to this, problems with the conveyance of the developer G are avoided, and it is possible to prevent density blotching or whiteout in the printed image.

Furthermore since, by performing the etching processing upon the magnetic blade 161 from both sides, there is no tilting of the processed surfaces, accordingly it is possible to suppress the long and narrow spikes in the development layer which is temporarily formed from being fractured. Accordingly, the development efficiency is better enhanced by performing the etching processing from both sides, than when performing said etching processing from one side only.

As will be understood by comparison of Embodiments 5 and 6 with Comparison Examples 11 and 12, when the ten-point average surface roughness of the development sleeve 14 was between 5 μm and 12 μm inclusive, the spikes up into which the developer G stood were uniformly formed. However, when the ten-point average surface roughness of the development sleeve 14 was less than 5 μm, then problems easily occurred with conveyance of the developer G from the beginning, and density blotching and whiteout took place easily while printing images. Conversely, when the ten-point average surface roughness of the development sleeve 14 was greater than 12 μm, then it became easy for the developer G to deteriorate, and the fluidity of the developer G was deteriorated.

As will be understood by comparison of Embodiment 1 with Comparison Example 7, when the development sleeve 14 is made from a non-magnetic stainless steel material, the advantageous effect of suppression of filming upon the development sleeve 14 was more satisfactory, than when it was made from aluminum.

As compared with the case of a development sleeve made from aluminum as used in the prior art, the thermal conductivity of such a development sleeve 14 which is made from a non-magnetic stainless steel material is lower. Due to this, such a development sleeve 14 which is made from a non-magnetic stainless steel material does not easily experience influence due to heat or the like transmitted from the main body of the image forming apparatus 1, and filming of the developer G is suppressed, since it is harder to heat up such a development sleeve.

In conclusion, all of the details have been given by way of example, and are not to be considered as being limitative of the technology in any way. The scope of the technology is to be defined, not by the embodiment described above, but solely by the range of the following Claims. Moreover, it is intended that the scope of the technology shall include all changes, modifications, additions, and omissions within the meaning and the scope of the Claims, and equivalents to elements thereof.

What is claimed is:

1. A development device which, in image forming processing using a two-component developer, converts a latent electrostatic image borne upon a latent electrostatic image bearing member into a visible image, comprising:

a developer bearing member which rotates while bearing a two-component developer, and which conveys said two-component developer to a development region which opposes said latent electrostatic image bearing member;

a magnet which is fixedly disposed in the interior of said developer bearing member, and which has a plurality of magnetic poles; and a developer regulation member which opposes said developer bearing member at a position on the upstream side of said development region with respect to the direction of rotation of said developer bearing member, while providing a gap between them;

wherein said developer regulation member comprises at least a magnetic member, the thickness of said magnetic member along said rotational direction of said developer bearing member is between 0.2 mm and 0.4 mm inclusive, wherein the cross sectional area of said magnetic member, as calculated by multiplying the thickness of said magnetic member along said direction of rotation, and the height of said magnetic member along the radial direction of said developer bearing member, is between 1.0 $mm^2$ and 2.1 $mm^2$ inclusive, and wherein the magnetic permeability of said magnetic member is between 300 and 495 inclusive; and wherein:

if the distance over said developer bearing member, from the position thereupon which the center of said magnetic member along said rotational direction opposes, to the position thereupon at which the magnetism of that magnetic pole which is disposed closest to said position is a maximum, is termed L (mm), and the diameter of said developer bearing member is termed D (mm), then said magnetic member is disposed within the range in which the relationship $0 \leqq L/D \leqq 0.044$ holds.

2. A development device according to claim 1, wherein said magnetic member is made from a stainless steel material which includes nickel, and wherein a proportion of the nickel is 1% or less.

3. A development device according to claim 1, wherein said magnetic member is manufactured by etching processing.

4. A development device according to claim 3, wherein said magnetic member is manufactured by performing double sided etching processing both upon its surface which is disposed at the upstream side with respect to said direction of rotation, and also upon its surface which is disposed at the downstream side.

5. A development device according to claim 1, wherein the surface roughness of said developer bearing member is between 5 μm and 12 μm inclusive.

6. A development device according to claim 1, wherein said developer bearing member is made from a non-magnetic stainless steel material.

7. A development device according to claim 1, wherein, in said development region, said developer bearing member conveys developer from below to above.

8. An image forming apparatus comprising a development device according to claim 1.

* * * * *